United States Patent [19]

Marx et al.

[11] Patent Number: 4,920,365

[45] Date of Patent: Apr. 24, 1990

[54] ELECTRONIC DIGITAL TIMEPIECE HAVING A SEPARATE KEY FOR CONTROLLING THE SWITCHING OF THE DISPLAY FROM STANDARD TO DAYLIGHT SAVINGS TIME

[75] Inventors: Juergen Marx; Artur Weich, both of Nuremberg, Fed. Rep. of Germany

[73] Assignee: Siemens Aktiengesellschaft, Berlin & Munich, Fed. Rep. of Germany

[21] Appl. No.: 336,775

[22] Filed: Apr. 12, 1989

[30] Foreign Application Priority Data

Apr. 25, 1988 [DE] Fed. Rep. of Germany ..... 3813922

[51] Int. Cl.[5] ..... G04C 17/00

[52] U.S. Cl. ..... 368/242; 368/31; 368/34; 368/187

[58] Field of Search ..... 368/10, 15, 34, 35, 368/36, 31, 32, 28, 29, 185, 187

[56] References Cited

U.S. PATENT DOCUMENTS

| | | | |
|---|---|---|---|
| 3,855,783 | 12/1974 | Luce | 368/84 |
| 4,077,032 | 2/1978 | Volkman | 340/324 |
| 4,253,169 | 2/1981 | Salah | 368/15 |
| 4,582,434 | 4/1986 | Plangger et al. | 368/47 |

FOREIGN PATENT DOCUMENTS 0197336 10/1986 European Pat. Off. .

OTHER PUBLICATIONS

Patent Abstracts of Japan, vol. 1, No. 86, 8/11/77, p. 1914 E 77; and JP-A-52-21863 (Suwa Seikosha K.K.), 2/18/77.

Patent Abstracts of Japan, vol. 6, No. 66 (P-112) [944], 4/27/82; and JP-A-57-6387 (Rhythm Tokei Kogyo K.K.), 1/13/82.

Patent Abstracts of Japan, vol. 6, No. 79 (P-115) [957], 5/18/82; and JP-A-57-16383 (Rhythm Tokei Kogyo K.K.), 1/27/82.

*Primary Examiner*—Bernard Roskoski

*Attorney, Agent, or Firm*—Kenyon & Kenyon

[57] ABSTRACT

A colon appearing on the display of an electronic digital timepiece between the hours and the minutes display serves as a display means for the time complexes "daylight-saving time" and "standard time", One point of the colon is surrounded by a first symbol for daylight-saving time and the other point is surrounded with a second symbol for standard time. In accordance with the selected time complex, these symbols appear on the display either continuously or for a period of time upon being recalled.

2 Claims, 1 Drawing Sheet

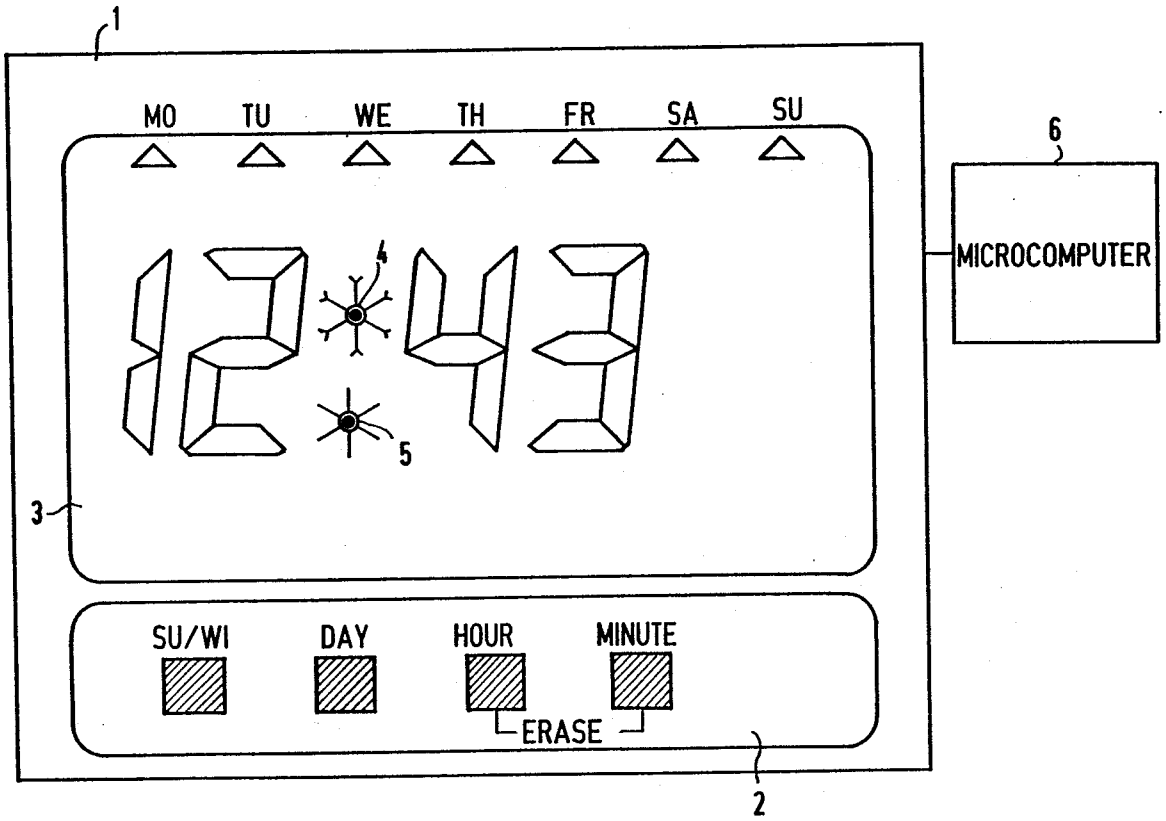
MICROCOMPUTER
6
1
MO
TU
WE
TH
FR
SA
SU
4
5
3
2
SU/WI
DAY
HOUR
MINUTE
ERASE

ELECTRONIC DIGITAL TIMEPIECE HAVING A SEPARATE KEY FOR CONTROLLING THE SWITCHING OF THE DISPLAY FROM STANDARD TO DAYLIGHT SAVINGS TIME

FIELD OF THE INVENTION

The invention relates to an electronic digital timepiece and, more particularly to a timepiece having a display for the digital display of the actual time-of-day and other possible data. The display includes means for indicating whether the display is showing standard or daylight saving time, i.e., the "time complex".

BACKGROUND OF THE INVENTION

Prior art timepieces generally have had the problem of requiring a complicated adjustment procedure to change over from the time complex for daylight-saving time to that for standard time. To simplify this procedure, an electronic digital clock, as shown from the EP-A-0 197 336, has a separate selector button by which the hour display can be adjusted by ±one hour. However, there is no indication whether the time displayed is for daylight-saving time or for standard time. Each time the selector button is pressed, the hour display is alternately switched ahead or back by one hour. A problem develops if the button is pressed twice by mistake. This has the effect of switching the display back to the original time complex. The use of separate luminous markings to display the currently selected time complex poses a problem as the timepieces usually only have very small displays and therefore cannot accommodate such an additional making.

SUMMARY OF THE INVENTION

The present invention provides a timepiece having a display marking for the time complexes designated daylight-saving time and standard time. The display marking is closely associated with the timepiece display and does not utilize any additional space on the display.

A further advantage of the present invention ensures that the time-of-day can only be entered on the display, if the selected time complex (daylight-saving time/-standard time) has been entered first. Thus, the entered time is clearly assigned to one of the time complexes. Yet another advantage of the present invention is that the timepiece, by use of the display features, prevents confusion between the actual time of day and the entered switching times when the timepiece is used as a timer switch.

BRIEF DESCRIPTION OF THE DRAWINGS

The FIGURE illustrates a timepiece display in accordance with the present invention.

DETAILED DESCRIPTION

Referring to the FIGURE, there is shown a panel 1 of an electronic digital clock containing an operating element 2 and a display 3. It is apparent that the FIGURE illustrates only one example of a clock panel and that another design may be used without departing from the principles of the invention. The actual time-of-day "12:43" appears on this display in a standard seven segment display form. A colon 4, 5 is located between the hours and minutes display. On the upper edge of the display 3, luminous indicators are provided for each of the days-of-the-week, as indicated by the abbreviations (SU-SA) on the cover plate 1. The operating element 2 contains four buttons designated in sequence as: "SO/WI" for the switching from daylight-saving time to standard time; "DAY" for the cyclical switching to each of the days-of-the-week; "HOUR" for switching the hour display; and "MINUTE" for switching the minute display. Each of the points 4, 5 of the colon between the hour and minute display is encircled by a symbol designated by 6 for standard time and 7 for daylight-saving time. Both symbols can be alternately controlled by the SO/WI-button and, when activated, are constantly lighted. Further, a cpu 8 is shown coupled to the timepiece for use when the timepiece operates as a timer switch.

In the operation and initialization or setting of the display, the operator starts from an initial state attained by simultaneously pressing both the "HOUR" and "MINUTE" buttons. This has the effect of bringing the day-of-the-week display to Sunday SU and the hour and minute display to zero "00:00". At this point, the symbols for standard time 6 and for daylight saving time 5 flash on and off. The selected symbol (6 or 7) is then constantly lighted while the symbol, which is not selected, goes out. During the time period that one of the symbols is constantly lighted, the colon flashes. At this point in the procedure, the actual day-of-the-week can be adjusted with the "DAY" button, and the hours and minutes of the actual time-of-day can be adjusted with the hours "HOUR" and minutes "MINUTE" buttons. By repeatedly activating the SO/WI button, the operator can switch from daylight saving time to standard time and back again. Thereby, with each activation, the respective symbol 6 or 7 lights up and the hour display is changed by ±1 hour. The design of the circuitry necessary to perform the functions of the timepiece is well known to those of ordinary skill in the art.

Furthermore, the timepiece of the present invention can be used as a timer switch clock. The purpose of timer clocks is to connect and disconnect electrically controllable apparatuses, e.g., space heating systems, at given pre-set times. The electronic timer switch has the advantage of expanded use over mechanical timer switches. For example, the time-dependent connecting and disconnecting at different times on individual weekdays is more easily accomplished. It is thus possible to store a timer program for connecting and disconnecting on each individual weekday or a group of weekdays and to access it on the individual weekdays. The timer switch uses one additional button (not shown) to assign the appropriate times-of-day and days-of-the-week to the desired switching on or off points. For purpose of the timer switch, then, an additional button must be arranged in a well-known manner, so that when it is pressed, the colon lights up statically. Also, the days, hours and minutes can be adjusted appropriately with the corresponding buttons, as provided above. After a certain elapsed time from when the adjustment procedure for the switching times has been completed, or by selecting an additional button, one can switch back to the "actual time of the day".

The time-of-day and day-of-the-week can also be adjusted with a single button. Using the single button, i.e., by pressing the button, the operator first selects the display of the minutes, and, after the minutes flash, the hour display. After the hour display flashes, the day-of-the-week is then selected. Then, the button is held down again, until the minutes finish flashing and the respective hour appears on the display, whereby the operator presses the button again to adjust the minutes. As stated above, the design of the circuitry to perform these functions is well known to those of ordinary skill in the art.

What is claimed is:

1. An electronic digital timepiece having a display for the digital display of the actual time-of-day, said display having a colon located between an hours display and a minutes display and flashing in a seconds cycle, said timepiece further having a plurality of keys to cyclically shift the hours and minutes and to adjust any additional data in said display, the timepiece comprising:

(a) a separate key for controlling the switching of the display from daylight saving time to standard time and from standard time to daylight saving time;

(b) said colon serving as a means for displaying both daylight saving time and standard time by further comprising:

(i) a first symbol indicating daylight saving time associated with one point of the colon;

(ii) a second symbol indicating standard time associated with the other point of the colon wherein one of said first and second symbols is selected and appears continuously on the display;

(c) said selected symbol functioning to only appear on the display for a period of time upon recalling the selected symbol;

(d) said timepiece further functioning wherein upon resetting the display, the first and second symbols flash without the colon points, and further wherein, after activating the separate key for daylight saving time or standard time, the selected symbol appears statically on the display and the colon points flash; and wherein the actual time-of-day can only be adjusted after the selected symbol is entered.

2. A digital timepiece according to claim 1, further comprising a computer controlled program setting device having a switch for the on/off control of an electric device at a switching time and wherein the first and second symbols are extinguished and the switching time appears with the colon being statically displayed when the time-of-day appears as a switching point to switch the electric device on and off.

* * * * *